US008789498B2

(12) United States Patent
Kumagai

(10) Patent No.: US 8,789,498 B2
(45) Date of Patent: Jul. 29, 2014

(54) INTERNAL COMBUSTION ENGINE AND STRADDLE-TYPE VEHICLE INCLUDING THE SAME

(71) Applicant: Yamaha Hatsudoki Kabushiki Kaisha, Iwata (JP)

(72) Inventor: Satoshi Kumagai, Shizuoka (JP)

(73) Assignee: Yamaha Hatsudoki Kabushiki Kaisha, Shizuoka (JP)

( * ) Notice: Subject to any disclaimer, the term of this patent is extended or adjusted under 35 U.S.C. 154(b) by 0 days.

(21) Appl. No.: 13/744,673

(22) Filed: Jan. 18, 2013

(65) Prior Publication Data

US 2013/0186353 A1 Jul. 25, 2013

(30) Foreign Application Priority Data

Jan. 24, 2012 (JP) ..... 2012-012229

(51) Int. Cl.
*F01P 1/02* (2006.01)

(52) U.S. Cl.
USPC ..... 123/41.7; 180/68.1

(58) Field of Classification Search
USPC ..... 123/41.55–41.57, 41.41, 41.62, 41.69, 123/41.7, 195 C; 180/68.1, 68.2, 229
See application file for complete search history.

(56) References Cited

U.S. PATENT DOCUMENTS 4,632,070 A * 12/1986 Onda et al. ..... 123/41.58
4,890,583 A * 1/1990 Ohno et al. ..... 123/41.7

FOREIGN PATENT DOCUMENTS

JP 7253019 * 10/1995 ..... F01P 1/02
JP 7-293238 A 11/1995
JP 2001-317349 A 11/2001
JP 2004285852 * 10/2004 ..... F01P 1/02

OTHER PUBLICATIONS

Kumagai, "Internal Combustion Engine and Straddle-Type Vehicle Including the Same", U.S. Appl. No. 13/744,661, filed Jan. 18, 2013.

* cited by examiner

*Primary Examiner* — Hung Q Nguyen
(74) *Attorney, Agent, or Firm* — Keating & Bennett, LLP

(57) ABSTRACT

An engine includes a crankcase, a cylinder block, a cylinder head, a piston, a cooling fan, and a shroud having an inner wall portion and an outer wall portion. A suction port is provided in a region of the outer wall portion facing the cooling fan. The inner and outer wall portions define a duct extending from the suction port to reach at least a portion of the cylinder block and/or at least a portion of the cylinder head.

15 Claims, 13 Drawing Sheets

INTERNAL COMBUSTION ENGINE AND STRADDLE-TYPE VEHICLE INCLUDING THE SAME

BACKGROUND OF THE INVENTION

1. Field of the Invention

The present invention relates to internal combustion engines and straddle-type vehicles including the internal combustion engines.

2. Description of the Related Art

A conventionally known internal combustion engine (hereinafter referred to as an engine) of a vehicle such as a motorcycle includes a shroud for covering a portion of the engine and a cooling fan for supplying air to inside of the shroud (see JP-A-7-293238 and JP-A-2001-317349, for example). In such an engine, the cooling fan produces a flow of air inside the shroud. Thus, a portion of the engine is cooled by the air. This type of engine is idiomatically referred to as a "forced air-cooled engine".

JP-A-7-293238 discloses an engine including an air supply fan connected to an end of a crankshaft, and an air supply cover for covering the air supply fan, a cylinder block, a cylinder head and a head cover. In a region of the air supply cover facing the air supply fan, there is formed a suction port through which air is sucked. The air sucked through the suction port is supplied to the whole of the cylinder block, the cylinder head and the head cover.

JP-A-2001-317349 discloses an engine including a cooling fan connected to an end of a crankshaft, and a cooling wind cowling for covering the cooling fan, a cylinder block, and a cylinder head. In a region of the cooling wind cowling facing the cooling fan, there is formed a suction port. Air sucked through the suction port is supplied to the whole of the cylinder block and the cylinder head.

SUMMARY OF THE INVENTION

The inventor of the present invention has realized that, in an engine of a straddle-type vehicle, a further improvement in fuel efficiency is desired. To this end, a conceivable solution is to enhance cooling of the engine.

Accordingly, preferred embodiments of the present invention provide a new forced air-cooled engine that improves fuel efficiency by enhancing cooling efficiency.

The inventor of the present invention has realized that fuel efficiency can be improved by enhancing engine cooling efficiency more than ever before. The present inventor has also conceived that an internal combustion engine including a shroud is cooled based on a technical idea different from a conventional one so as to enhance cooling efficiency and improve fuel efficiency.

Specifically, in the conventional techniques, air is evenly supplied to the whole of the cylinder block and the cylinder head in an attempt to cool an extensive region of the engine. In order to allow the air that is sucked through the suction port to be supplied to the whole of the cylinder block and the cylinder head, a cross-sectional area of an air flow passage located inside the air supply cover or inside the cooling wind cowling is considerably increased at some position along the air flow passage. Therefore, a flow velocity of the air inside the air flow passage is considerably reduced at some position along the air flow passage. The air is supplied to the cylinder block and the cylinder head at a low flow velocity. Consequently, in the above-described conventional techniques, air can be supplied to an extensive region of the engine, but local cooling efficiency is low.

However, a temperature distribution in an engine is not uniform, and the temperature of the engine varies from position to position. Overall cooling efficiency obtained when a particular region is cooled at high cooling efficiency can be higher than that obtained when an extensive region is cooled at low cooling efficiency. In the former case, fan power may be reduced or a resulting structure may be reduced in size. The present inventor has given attention to this point to develop and implement preferred embodiments of the present invention.

An internal combustion engine according to a preferred embodiment of the present invention includes a crankshaft, a crankcase supporting the crankshaft, a cylinder block connected to the crankcase and including a cylinder provided therein, a piston connected to the crankshaft via a connecting rod and located inside the cylinder so as to be movable in a reciprocating manner, a cylinder head superposed on the cylinder block so as to cover the cylinder, defining a combustion chamber together with the cylinder and the piston, and including an intake port and an exhaust port communicated with the combustion chamber, a cooling fan rotated together with the crankshaft, and a shroud including an inner wall portion located laterally of at least one of a portion of the crankcase, a portion of the cylinder block and a portion of the cylinder head, and an outer wall portion arranged to cover the cooling fan, the inner wall portion, a portion of the crankcase, at least a portion of the cylinder block and at least a portion of the cylinder head. A suction port arranged to suction air is preferably provided in a region of the outer wall portion facing the cooling fan. The inner and outer wall portions define a duct extending from the suction port to reach at least a portion of the cylinder block and/or at least a portion of the cylinder head.

In the above-described internal combustion engine, the shroud preferably includes not only the outer wall portion but also the inner wall portion. The inner and outer wall portions define the duct extending from the suction port to reach at least a portion of the cylinder block and/or at least a portion of the cylinder head, thus preventing a sharp increase in cross-sectional area of an air flow passage inside the shroud. Therefore, a reduction in flow velocity of air supplied by the cooling fan can be prevented. For example, the position of the inner wall portion is appropriately set, and through the duct, air is guided at a high flow velocity to a region that should be cooled in a concentrated manner, thus making it possible to provide highly efficient local cooling to this region. Consequently, cooling efficiency can be enhanced on the whole, thus enabling an improvement in fuel efficiency. Besides, fan power can be reduced or a resulting structure can be reduced in size.

According to a preferred embodiment of the present invention, when a cross section passing through a center of the crankshaft and parallel to an axis of the cylinder is viewed in a direction perpendicular to the cross section, one end of the inner wall portion is preferably located laterally of the crankcase, and the other end of the inner wall portion is preferably located laterally of a region of the cylinder block closer to the cylinder head than a bottom dead center of the piston.

Thus, air can be guided at a high flow velocity to the region of the cylinder block closer to the cylinder head than the bottom dead center of the piston and the cylinder head. Temperatures of this region and the cylinder head are more likely to increase than those of the other regions. Accordingly, air is guided at a high flow velocity to this region and the cylinder head so as to make it possible to enhance cooling efficiency on the whole.

According to another preferred embodiment of the present invention, the other end of the inner wall portion preferably abuts against the region of the cylinder block closer to the cylinder head than the bottom dead center of the piston.

Thus, suitable cooling can be performed on the region of the cylinder block closer to the cylinder head than the bottom dead center of the piston and the cylinder head.

According to still another preferred embodiment of the present invention, an inlet of the duct is preferably defined by an end of the inner wall portion located close to the cooling fan and the outer wall portion. At some position along the duct, there is preferably provided a region having a flow passage cross-sectional area smaller than that of the inlet of the duct.

Thus, the flow velocity of air can be increased at some position along the duct. Since a reduction in flow velocity of air can be effectively prevented, cooling can be performed locally at high cooling efficiency outside of an outlet of the duct.

According to yet another preferred embodiment of the present invention, the cooling fan preferably includes a rotation shaft, and the shroud preferably includes a longitudinal wall portion that extends in a direction parallel or substantially parallel to a direction of the rotation shaft of the cooling fan or in a direction inclined with respect to the direction of the rotation shaft. The longitudinal wall portion preferably surrounds at least a portion of a periphery of the cooling fan when viewed in the direction of the rotation shaft of the cooling fan. A portion of the inner wall portion preferably also serves as a portion of the longitudinal wall portion.

Thus, the inner wall portion can be easily located closer to the outer wall portion, and a flow passage cross-sectional area therebetween can be reduced so as to further increase the flow velocity of air.

According to still yet another preferred embodiment of the present invention, the cooling fan preferably includes a rotation shaft, and the shroud preferably includes a longitudinal wall portion that extends in a direction parallel or substantially parallel to a direction of the rotation shaft of the cooling fan or in a direction inclined with respect to the direction of the rotation shaft. The longitudinal wall portion preferably surrounds at least a portion of a periphery of the cooling fan when viewed in the direction of the rotation shaft of the cooling fan. The longitudinal wall portion is preferably arranged so that a distance between the longitudinal wall portion and an outer periphery of the cooling fan is gradually increased along a rotation direction of the cooling fan.

Thus, a "spiral casing" can be provided around the cooling fan, and air can be efficiently supplied from the cooling fan to the duct.

According to another preferred embodiment of the present invention, the crankshaft preferably extends rightward and leftward. The cylinder preferably extends in a horizontal direction or extends obliquely upward with respect to the horizontal direction. The shroud preferably includes a facing wall portion extending rightward or leftward from the duct and facing an upper or lower surface of at least a portion of the cylinder block. At least in a region of the cylinder block facing the facing wall portion, there are preferably provided a plurality of fins. A distance between at least some of the fins and the facing wall portion is preferably smaller than an interval between the fins.

Thus, air guided through the duct is supplied at least to a right or left surface of the cylinder block and then flows between the facing wall portion and the fins. In this case, since the distance between the facing wall portion and the fins is smaller than the interval between the fins, the amount of air flowing through gaps between the fins will be larger than the amount of air flowing between the facing wall portion and the fins. Therefore, the upper or lower surface of the cylinder block can be cooled at high cooling efficiency.

According to still another preferred embodiment of the present invention, the shroud preferably includes an inner member located toward an axis of the cylinder when a cross section passing through a center of the crankshaft and parallel to the cylinder axis is viewed in a direction perpendicular to the cross section, and an outer member that is separate from the inner member and located opposite to the inner member located toward the cylinder axis. The outer member preferably defines at least a portion of the outer wall portion. The inner member preferably defines at least the inner wall portion. The inner and outer members are preferably assembled to each other.

As described above, the inner wall portion and at least a portion of the outer wall portion are preferably defined by separate members, and these members are assembled to each other afterward, thus making it possible to easily provide the shroud including the inner and outer wall portions.

According to yet another preferred embodiment of the present invention, the inner and outer members are each preferably made of a resin material. Thus, the shroud can be easily formed.

According to still yet another preferred embodiment of the present invention, in a region of the inner wall portion of the inner member located toward the cylinder axis, a reinforcement rib is preferably provided.

Thus, rigidity of the inner wall portion can be maintained at a high level. Since the rigidity of the inner wall portion can be maintained at a high level, flexibility of shape and location of the inner wall portion can be increased.

According to another preferred embodiment of the present invention, the internal combustion engine is preferably a single-cylinder engine, for example. Thus, the foregoing effects are obtainable in the single-cylinder engine.

According to still another preferred embodiment of the present invention, the inner wall portion is preferably located laterally of a portion of the cylinder block. In a region of the cylinder block located laterally of the inner wall portion, there are preferably provided first fins. In a region of the cylinder block which is not located laterally of the inner wall portion and which is covered by the outer wall portion, there are preferably provided second fins. A fin pitch between the first fins and a fin pitch between the second fins are preferably different from each other.

The fin pitch between the first fins and the fin pitch between the second fins are different from each other as described above, thus making it possible to vary cooling characteristics between a region of the cylinder block to which air from the cooling fan is not guided (i.e., a region of the cylinder block located laterally of the inner wall portion) and a region of the cylinder block to which air from the cooling fan is guided (i.e., a region of the cylinder block not located laterally of the inner wall portion). The cooling characteristic is appropriately set for each spot of the cylinder block, and whether to supply air thereto is appropriately set, thus enabling cooling in various modes.

According to yet another preferred embodiment of the present invention, the fin pitch between the first fins is preferably greater than the fin pitch between the second fins.

When the fin pitch is small, air resistance is increased. However, air is guided to the second fins at a high flow velocity. Hence, air is allowed to suitably flow around the second fins so as to enable effective cooling.

A straddle-type vehicle according to yet another preferred embodiment of the present invention includes the above-described internal combustion engine. Thus, the foregoing effects are obtainable in the straddle-type vehicle.

According to another preferred embodiment of the present invention, the straddle-type vehicle preferably includes a body frame facing the outer wall portion. A recess is preferably provided in a region of the outer wall portion facing the body frame.

Thus, it is possible to allow the shroud to be located close to the body frame while avoiding interference between the shroud and the body frame. Hence, an interval between the shroud and the body frame can be reduced to enable the straddle-type vehicle to be reduced in size. Accordingly, installation of the engine on the straddle-type vehicle can be further facilitated.

Various preferred embodiments of the present invention provide a new forced air-cooled engine that enhances cooling efficiency.

The above and other elements, features, steps, characteristics and advantages of the present invention will become more apparent from the following detailed description of the preferred embodiments with reference to the attached drawings.

DETAILED DESCRIPTION OF THE PREFERRED EMBODIMENTS

First Preferred Embodiment

Figure 1:
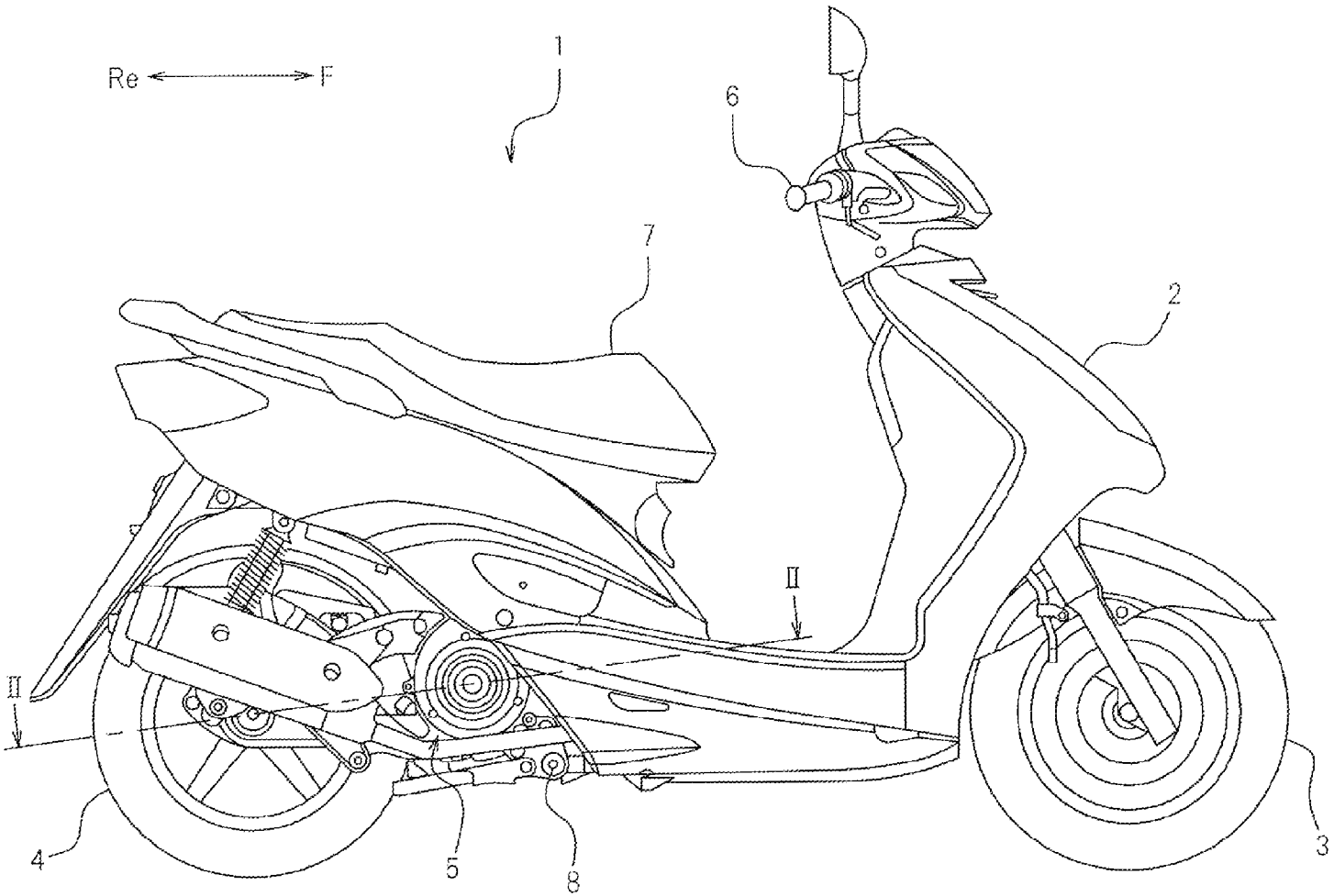
FIG. 1 is a right side view of a motorcycle according to a first preferred embodiment of the present invention.

As illustrated in FIG. 1, a straddle-type vehicle according to the present preferred embodiment is a scooter-type motorcycle 1, for example. The motorcycle 1 is just an example of the straddle-type vehicle according to a preferred embodiment of the present invention, and the straddle-type vehicle according to the present invention is not limited to the scooter-type motorcycle 1. The straddle-type vehicle according to the present invention may be any other type of motorcycle such as a "moped-type", "off-road" or "street" motorcycle, for example. The straddle-type vehicle according to preferred embodiments of the present invention refers to any vehicle that an occupant straddles when getting on the vehicle, and is not limited to a two-wheeled vehicle. The straddle-type vehicle according to the present invention may be, for example, a tricycle of a type in which a traveling direction is changed by tilting a body of the tricycle, or may be any other straddle-type vehicle such as an ATV (All Terrain Vehicle), for example.

In the following description, "front", "rear", "right" and "left" mean front, rear, right and left with respect to an occupant of the motorcycle 1, respectively. Reference signs "F", "Re", "R" and "L" used in the drawings represent front, rear, right and left, respectively.

The motorcycle 1 preferably includes a motorcycle main body 2, a front wheel 3, a rear wheel 4, and an engine unit 5 that drives the rear wheel 4. The motorcycle main body 2 preferably includes a handlebar 6 operated by the occupant and a seat 7 on which the occupant sits. The engine unit 5 preferably is a "unit swing type" engine unit, for example. The engine unit 5 is supported by a body frame (not illustrated in FIG. 1) so as to be swingable around a pivot shaft 8. In other words, the engine unit 5 is supported by the body frame in a swingable manner.

Figure 2:
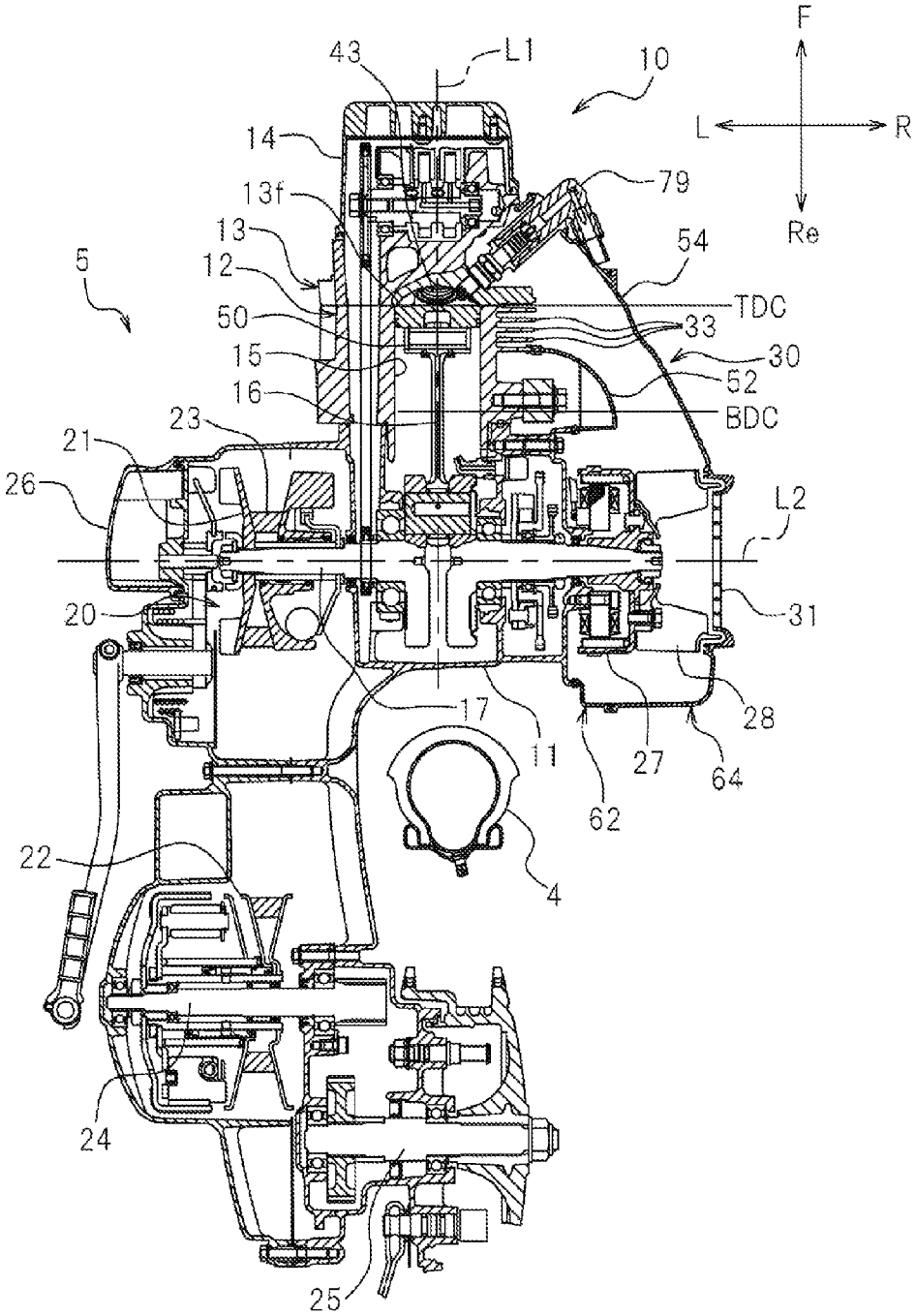
FIG. 2 is a cross-sectional view taken along the line II-II of FIG. 1.
Figure 3:
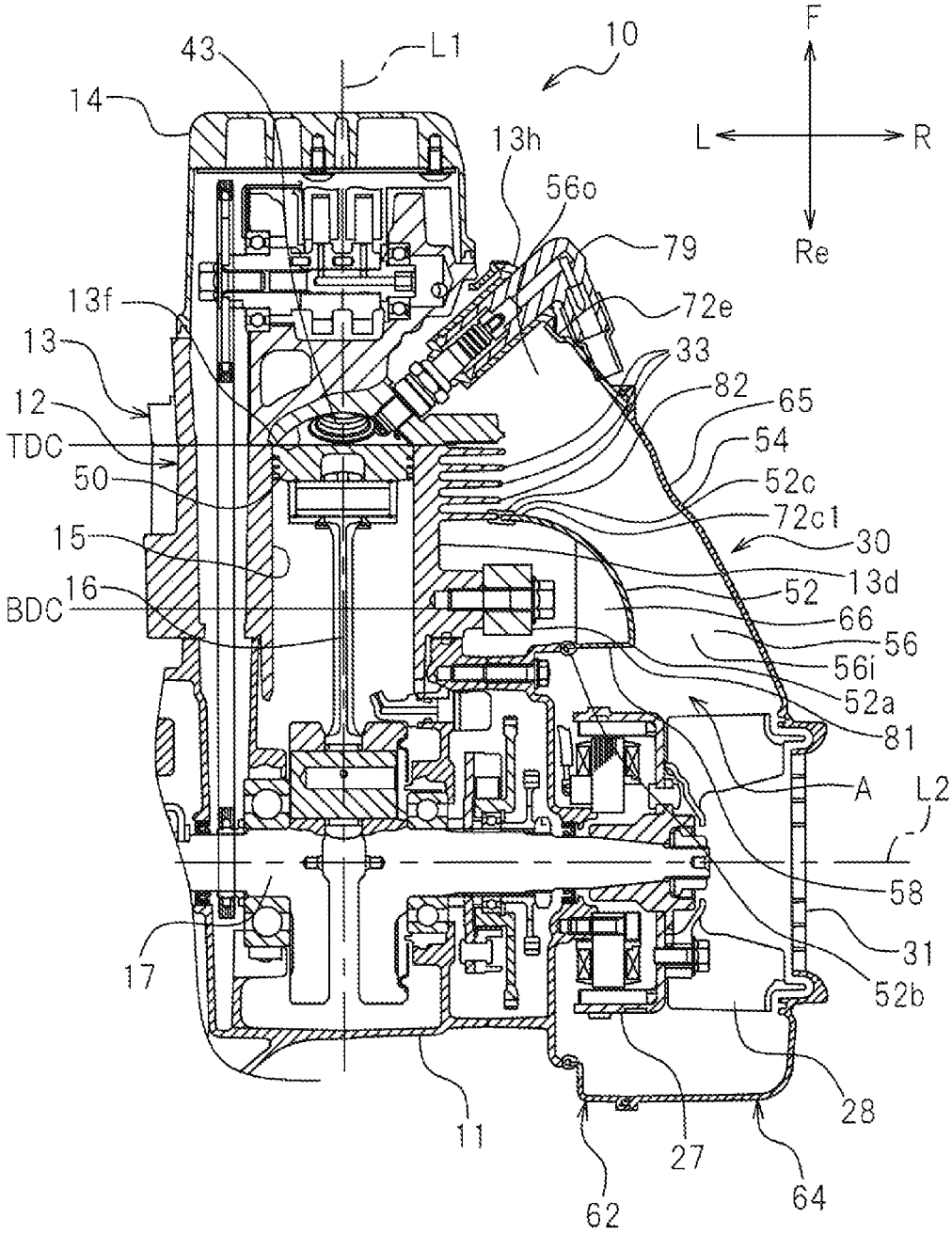
FIG. 3 is an enlarged view of a portion of the motorcycle such as a portion of an engine illustrated in FIG. 2.

FIG. 2 is a cross-sectional view taken along the line II-II of FIG. 1. FIG. 3 is an enlarged view of a portion of the motorcycle 1 such as a portion of an engine 10 illustrated in the cross-sectional view of FIG. 2. As illustrated in FIG. 2, the engine unit 5 preferably includes the engine 10 serving as an example of an internal combustion engine according to a preferred embodiment of the present invention and a V-belt type continuously variable transmission (hereinafter referred to as a "CVT") 20. In the present preferred embodiment, the engine 10 and the CVT 20 are preferably provided in an integrated manner to form the engine unit 5, for example. However, the engine 10 and the transmission may naturally be provided in a separate manner.

The engine 10 preferably is a single-cylinder engine equipped with a single cylinder, for example. The engine 10 preferably is a four-stroke engine that sequentially repeats an intake stroke, a compression stroke, a power stroke, and an exhaust stroke, for example. The engine 10 preferably includes a crankcase 11, a cylinder block 12 extending forward from the crankcase 11 and connected to the crankcase 11, a cylinder head 13 connected to a front portion of the cylinder block 12, and a cylinder head cover 14 connected to a front portion of the cylinder head 13. Note that as used herein, the term "forward" not only means forward in a strict sense, i.e., a direction parallel to a horizontal line, but also means a direction inclined with respect to a horizontal line. Inside the cylinder block 12, a cylinder 15 is provided.

Note that the cylinder 15 may preferably include, for example, a cylinder liner inserted into a main body of the cylinder block 12 (i.e., a region of the cylinder block 12 other than the cylinder 15), or may be integral with the main body of the cylinder block 12. In other words, the cylinder 15 may be separable from the main body of the cylinder block 12 or inseparable from the main body of the cylinder block 12. Inside the cylinder 15, a piston 50 is slidably provided. The piston 50 is arranged so as to be movable in a reciprocating manner between a top dead center TDC and a bottom dead center BDC.

The cylinder head 13 is superposed on the cylinder block 12 so as to cover the cylinder 15. As illustrated in FIG. 3, in the cylinder head 13, there are provided a concave region 13*f*, and intake and exhaust ports 41 and 42 (see FIG. 11) communicated with the concave region 13*f*. A top surface of the piston 50, an inner peripheral wall of the cylinder 15, and the concave region 13*f* define a combustion chamber 43. The piston 50 is connected to a crankshaft 17 via a connecting rod 16. The crankshaft 17 is extended rightward and leftward, and supported by the crankcase 11.

In the present preferred embodiment, the crankcase 11, the cylinder block 12, the cylinder head 13 and the cylinder head cover 14 preferably are separate components, and are assembled to each other. However, these components do not necessarily have to be separate components, but may be integral with each other where appropriate. For example, the crankcase 11 and the cylinder block 12 may be integral with each other, the cylinder block 12 and the cylinder head 13 may be integral with each other, and the cylinder head 13 and the cylinder head cover 14 may be integral with each other.

As illustrated in FIG. 2, the CVT 20 preferably includes a first pulley 21 defining and functioning as a driving pulley, a second pulley 22 defining and functioning as a driven pulley, and a V belt 23 wound around the first and second pulleys 21 and 22. A left end portion of the crankshaft 17 protrudes leftward from the crankcase 11. The first pulley 21 is attached to the left end portion of the crankshaft 17. The second pulley 22 is attached to a main shaft 24. The main shaft 24 is connected to a rear axle 25 via an unillustrated gear mechanism. Note that FIG. 2 illustrates a state where a transmission ratio is changed between front side and rear side regions of the first pulley 21. The same goes for the second pulley 22. The crankcase 11 is provided at its left side with a transmission case 26. The CVT 20 is contained inside the transmission case 26.

The crankshaft 17 is provided at its right portion with a generator 27. At a right end portion of the crankshaft 17, a cooling fan 28 is fixed. The cooling fan 28 is rotated together with the crankshaft 17. The cooling fan 28 is arranged to suck air leftward by being rotated. The crankcase 11, the cylinder block 12 and the cylinder head 13 are provided with a shroud 30. The generator 27 and the cooling fan 28 are contained inside the shroud 30. A specific structure of the shroud 30 will be described later.

Figure 4:
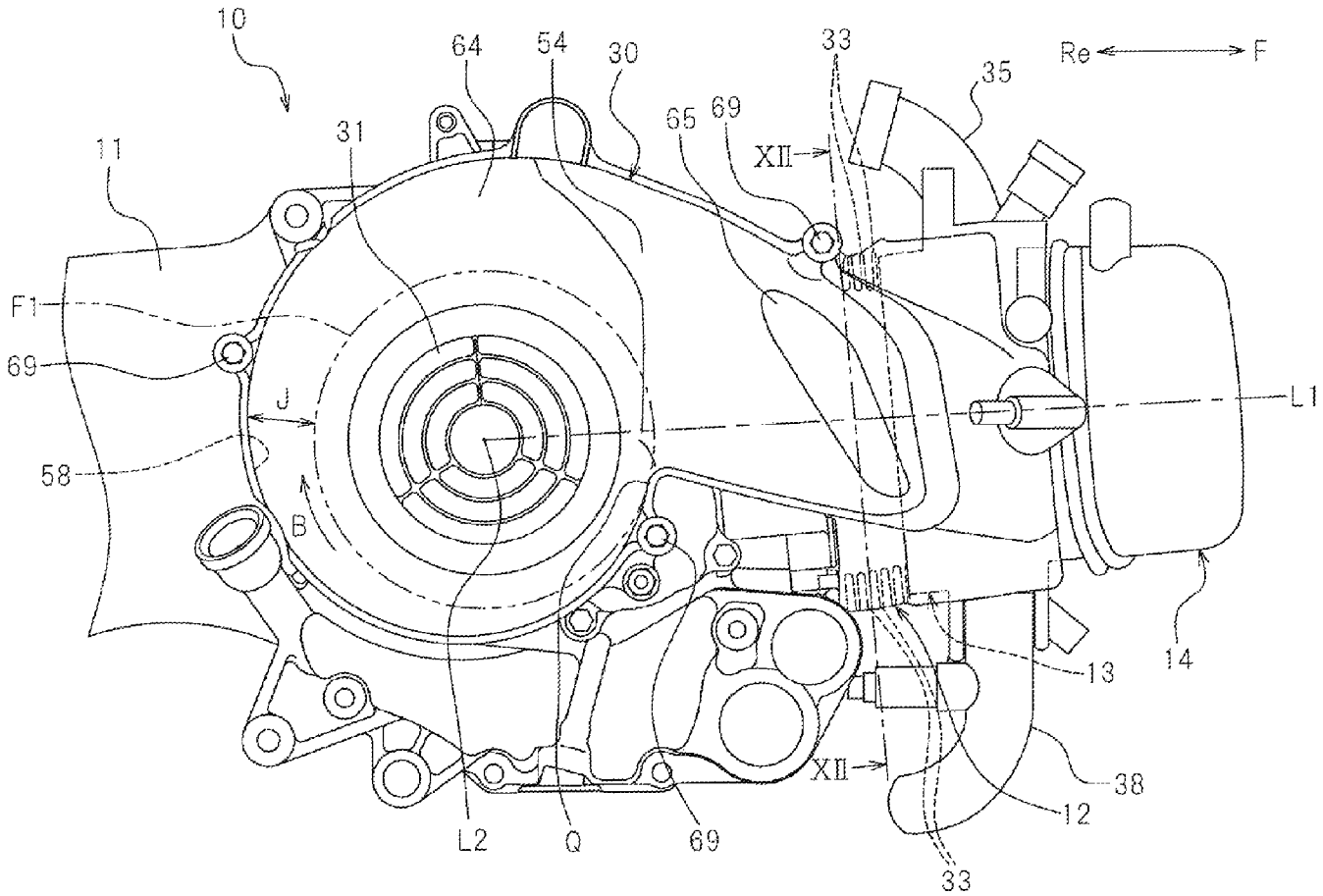
FIG. 4 is a right side view of a portion of the engine according to the first preferred embodiment of the present invention.

FIG. 4 is a right side view of a portion of the engine 10. As illustrated in FIG. 4, the engine 10 according to the present preferred embodiment is a "transverse" engine in which the cylinder block 12 and the cylinder head 13 extend in a horizontal direction or in a direction inclined slightly upward toward the front with respect to the horizontal direction. The reference sign "L1" represents a line passing through a center of the cylinder 15 (see FIG. 2). Hereinafter, this line will be referred to as a "cylinder axis L1". The cylinder axis L1 extends in a horizontal direction or in a direction inclined slightly with respect to the horizontal direction. However, the direction of the cylinder axis L1 is not limited to any particular direction. For example, the cylinder axis L1 may have an inclination angle of about 0° to about 15° or an inclination angle of about 15° or more with respect to a horizontal plane. The cylinder head 13 is connected at its upper portion with an intake pipe 35. The cylinder head 13 is connected at its lower portion with an exhaust pipe 38. Inside the cylinder head 13, the intake and exhaust ports 41 and 42 (see FIG. 11) are formed. The intake pipe 35 is connected to the intake port 41, and the exhaust pipe 38 is connected to the exhaust port 42. The intake and exhaust ports 41 and 42 are provided with intake and exhaust valves 41A and 42A (see FIG. 11), respectively.

The engine 10 according to the present preferred embodiment is an air-cooled engine cooled by air. As illustrated in FIG. 2, in the cylinder block 12, there are provided a plurality of cooling fins 33. Note that the fins 33 may also be provided in component(s) other than the cylinder block 12. For example, the fins 33 may also be provided in the cylinder head 13 and/or the crankcase 11. The engine 10 may be entirely cooled by air, for example. Alternatively, the engine 10 may be partially cooled by cooling water, for example, even though the engine 10 includes the cooling fins 33. In other words, the engine 10 may be partially cooled by air and partially cooled by cooling water.

A specific shape of each fin 33 is not limited to any particular shape, but in the engine 10 according to the present preferred embodiment, each fin 33 preferably has the following shape. The fins 33 according to the present preferred embodiment protrude from a surface of at least a portion of the cylinder block 12 and cylinder head 13, and extend in a direction perpendicular or substantially perpendicular to the cylinder axis L1. In other words, the fins 33 extend in a direction perpendicular or substantially perpendicular to the surface of the cylinder block 12 or the cylinder head 13. The fins 33 are arranged along the direction of the cylinder axis L1. The fins 33 adjacent to each other have an interval therebetween. The fins 33 may be arranged at regular intervals or irregular intervals.

The plurality of fins 33 preferably have equal thicknesses. Alternatively, some of the fins 33 may have different thicknesses. The thickness of each fin 33 may be uniform at any spot, or may be different at some spots. In other words, the thickness of each fin 33 may be locally different.

In the present preferred embodiment, each fin 33 preferably has a flat plate shape, and a surface of each fin 33 is a flat surface. However, each fin 33 may be curved, and the surface of each fin 33 may be a curved surface. The shape of each fin 33 is not limited to a flat plate shape, but may be any other shape such as a needle shape or a semi-spherical shape, for example. When each fin 33 preferably has a flat plate shape, each fin 33 does not necessarily have to extend in a direction perpendicular or substantially perpendicular to the cylinder axis L1, but may extend in a direction parallel or substantially parallel to the cylinder axis L1. Alternatively, each fin 33 may extend in a direction inclined with respect to the cylinder axis L1. The plurality of fins 33 may extend in the same direction or may extend in different directions.

Figure 5:
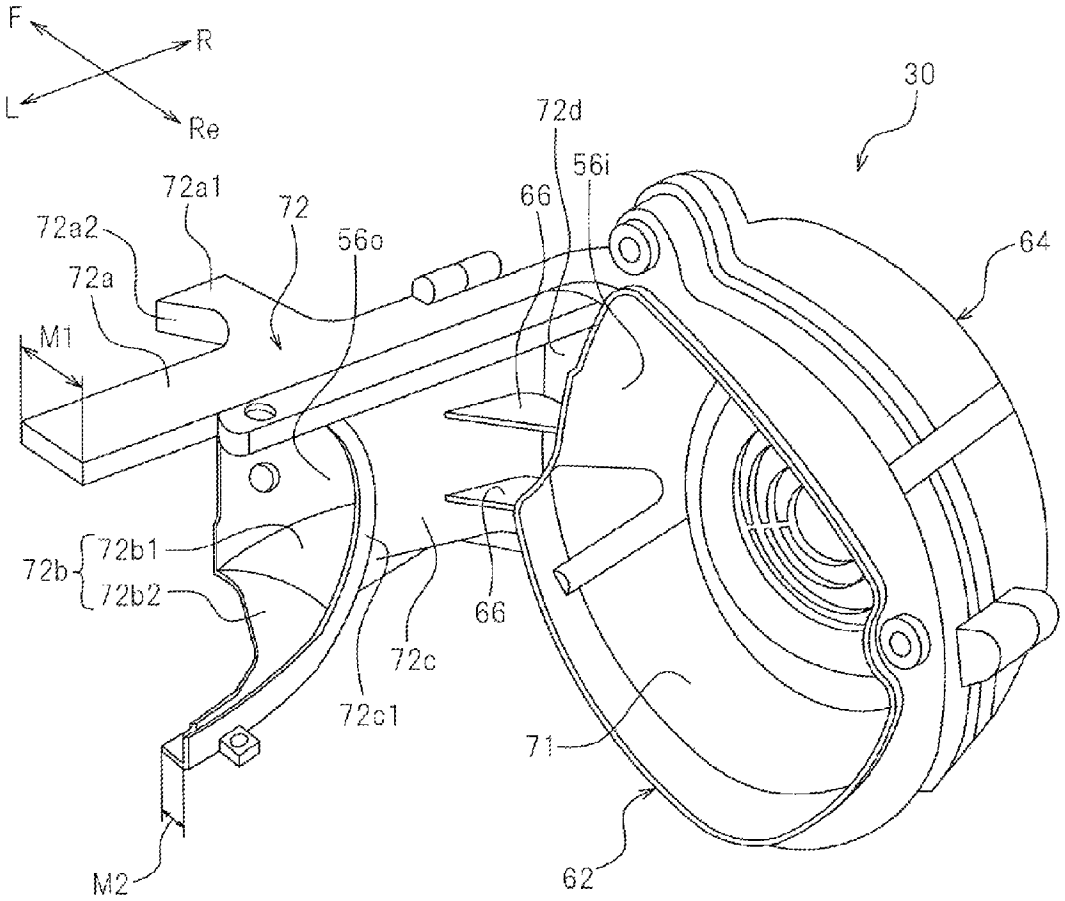
FIG. 5 is a perspective view of a shroud.
Figure 6:
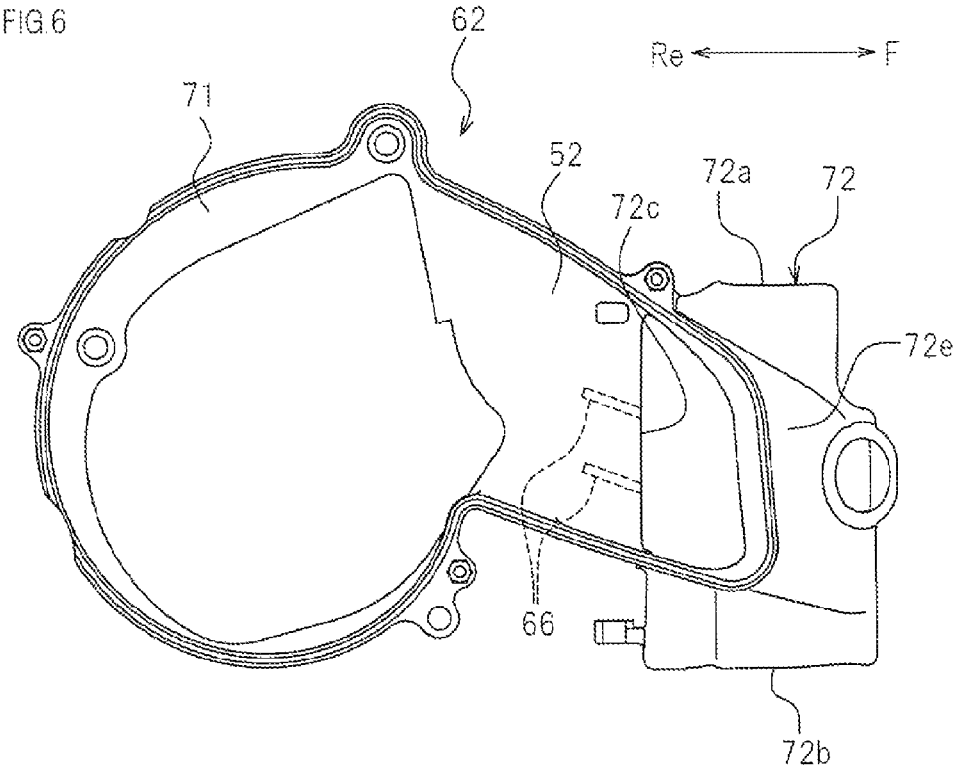
FIG. 6 is a front view of an inner member of the shroud.
Figure 7:
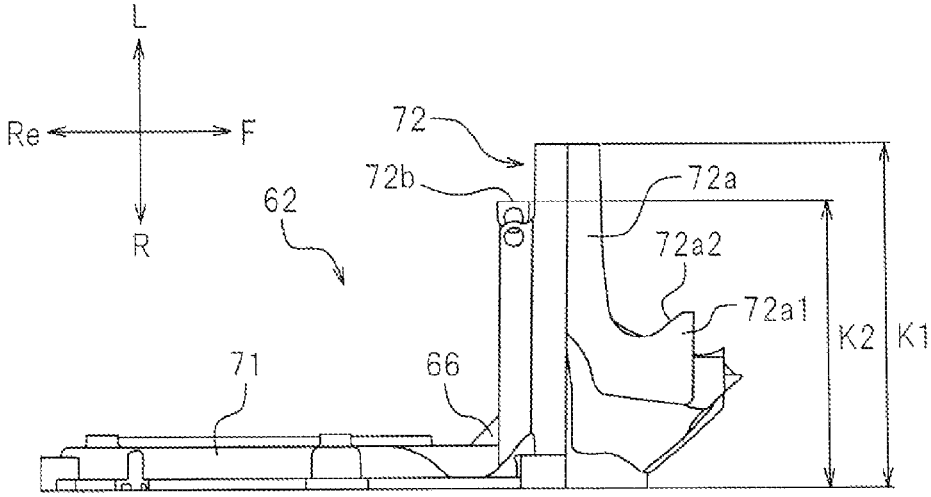
FIG. 7 is a plan view of the inner member of the shroud.
Figure 8:
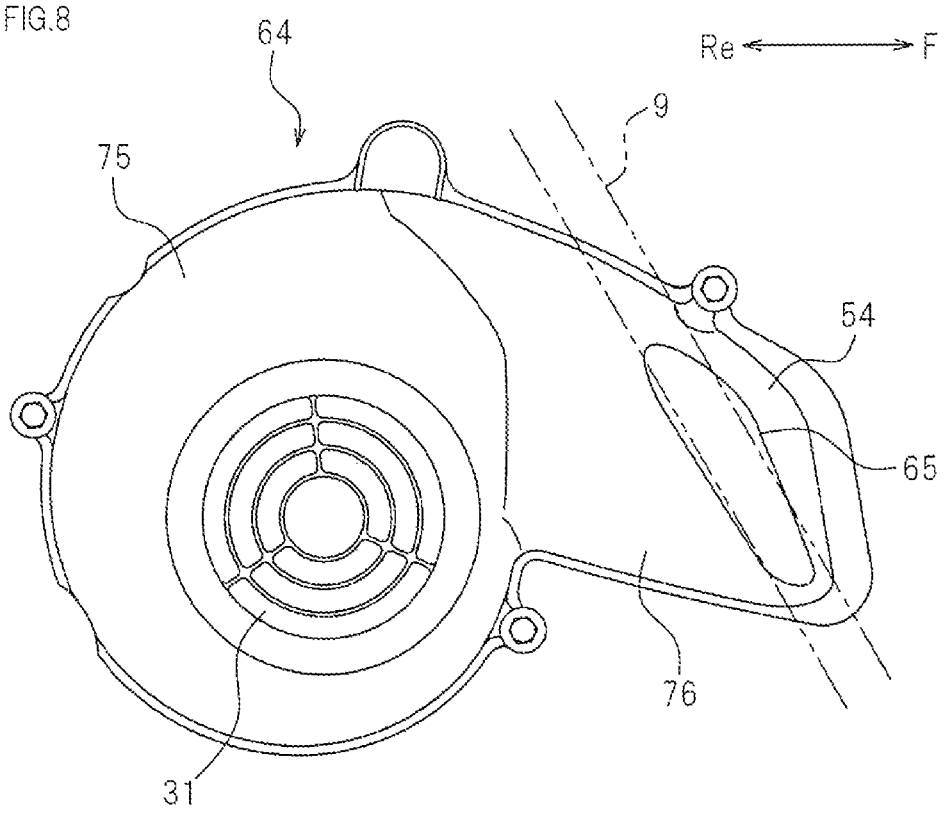
FIG. 8 is a front view of an outer member of the shroud.

Next, the specific structure of the shroud 30 will be described. FIG. 5 is a left rear perspective view of the shroud 30. The shroud 30 includes an inner member 62 and an outer member 64. The shroud 30 is formed preferably by assembling the inner and outer members 62 and 64 to each other. As illustrated in FIG. 4, the inner and outer members 62 and 64 are fixed to each other preferably with bolts 69, for example. However, the assembled structure of the inner and outer members 62 and 64 is not limited to any particular structure. FIG. 6 is a front view of the inner member 62. FIG. 7 is a plan view of the inner member 62. And FIG. 8 is a front view of the outer member 64. Note that FIGS. 6 and 8 are equivalent to right side views with respect to the vehicle. The inner and outer members 62 and 64 are each preferably made of a synthetic resin, for example. However, a material for each of the inner and outer members 62 and 64 is not limited to any particular material. The inner and outer members 62 and 64 may be made of the same material or may be made of different materials.

As illustrated in FIG. 7, the inner member 62 preferably is approximately L-shaped in plan view. As illustrated in FIG. 5, the inner member 62 preferably includes a substantially tubular rear portion 71 and a front portion 72 extending leftward from a front end of the rear portion 71. The front portion 72 preferably includes an inner wall 72*d* facing a lateral surface of the engine 10 (or more specifically, a right lateral surface of the cylinder block 12) and an outer wall 72*e* (see FIG. 6) facing a lateral surface of the engine 10 (or more specifically, a right lateral surface of the cylinder head 13). As illustrated in FIG. 3, in the outer wall 72*e*, there is provided a hole 13*h* into which an ignition device 79 such as an ignition plug is inserted. In the present preferred embodiment, the hole 13*h* preferably is a round hole surrounding the entire periphery of the ignition device 79. However, the hole 13*h* may have any other shape surrounding the entire periphery of the ignition device 79. The hole 13*h* may be, for example, an arc-shaped hole surrounding a portion of the periphery of the ignition device 79. As illustrated in FIG. 5, the front portion 72 preferably includes an upper wall 72*a* extending leftward from the inner and outer walls 72*d* and 72*e*, a lower wall 72*b* extending leftward from the inner and outer walls 72*d* and 72*e* and vertically facing the upper wall 72*a*, and a rear wall 72*c* extending leftward from the inner wall 72*d* and perpendicular or substantially perpendicular to the upper and lower walls 72*a* and 72*b*.

The upper wall 72*a* preferably has a horizontal plate shape extending laterally. At the upper wall 72*a*, there is provided a protrusion 72*a*1 protruding forward therefrom. A left lateral surface 72*a*2 of the protrusion 72*a*1 is curved. As illustrated in FIG. 7, the lateral surface 72*a*2 is arc-shaped in plan view.

As illustrated in FIG. 5, the lower wall 72*b* preferably includes a horizontal wall 72*b* 1 extending laterally, and an arc-shaped curved wall 72*b*2 extending obliquely leftward and downward from a left end portion of the horizontal wall 72*b*1.

The rear wall 72*c* extends vertically. Ata left end portion of the rear wall 72*c*, there is provided an arc-shaped curved portion 72*c*1. The curved portion 72*c*1 is arranged so as to be able to come into contact with the right lateral surface, upper surface and lower surface of the cylinder block 12 of the engine 10. In the present preferred embodiment, as illustrated in FIG. 3, the curved portion 72*c*1 abuts against the fin 33 via a seal member 82. Note that the curved portion 72*c*1 may abut against the fin 33 via a buffer member, or may abut against the fin 33 via an elastic member. Alternatively, the curved portion 72*c*1 may be allowed to directly abut against the fin 33.

As illustrated in FIG. 7, a left end portion of the upper wall 72*a* is located leftward of that of the lower wall 72*b*. In other words, the upper wall 72*a* has a longitudinal length K1 longer than a longitudinal length K2 of the lower wall 72*b*. As illustrated in FIG. 5, the left end portion of the upper wall 72*a* has a width M1 wider than a width M2 of the left end portion of the lower wall 72*b*.

At a corner region defined by the inner wall 72*d* and the rear wall 72*c*, there are provided a plurality of reinforcement ribs 66. Each reinforcement rib 66 preferably has a substantially right-angled triangle horizontal plate shape. Between the reinforcement ribs 66, there may be located a sensor that detects a state of the engine 10 (e.g., a knock sensor that detects knocking of the engine 10). In the present preferred embodiment, the two reinforcement ribs 66 are preferably provided, for example, but the number of the reinforcement ribs 66 is not limited to any particular number. The two reinforcement ribs 66 are vertically spaced apart from each other. The two reinforcement ribs 66 are parallel or substantially parallel to each other.

As illustrated in FIG. 8, the outer member 64 preferably includes a cup-shaped rear portion 75 and a front portion 76 extending forward from the rear portion 75. In the rear portion 75, a suction port 31 is provided. When the shroud 30 is attached to the engine unit 5, the suction port 31 is located at a position facing the cooling fan 28 (see FIG. 3). In the front portion 76, a recess 65 is provided. When the shroud 30 is attached to the engine unit 5, the recess 65 is located inwardly of a portion of a body frame 9 of the motorcycle 1. The recess 65 makes it possible to easily avoid interference between the shroud 30 and the body frame 9. In particular, in the motorcycle 1 according to the present preferred embodiment, the engine unit 5 is supported by the body frame 9 so as to be swingable with respect to the body frame 9, thus allowing the shroud 30 attached to the engine unit 5 to be relatively moved with respect to the body frame 9 in association with swinging movement of the engine unit 5. However, the recess 65 makes it possible to more reliably prevent contact between the shroud 30 and the body frame 9.

Figure 9:
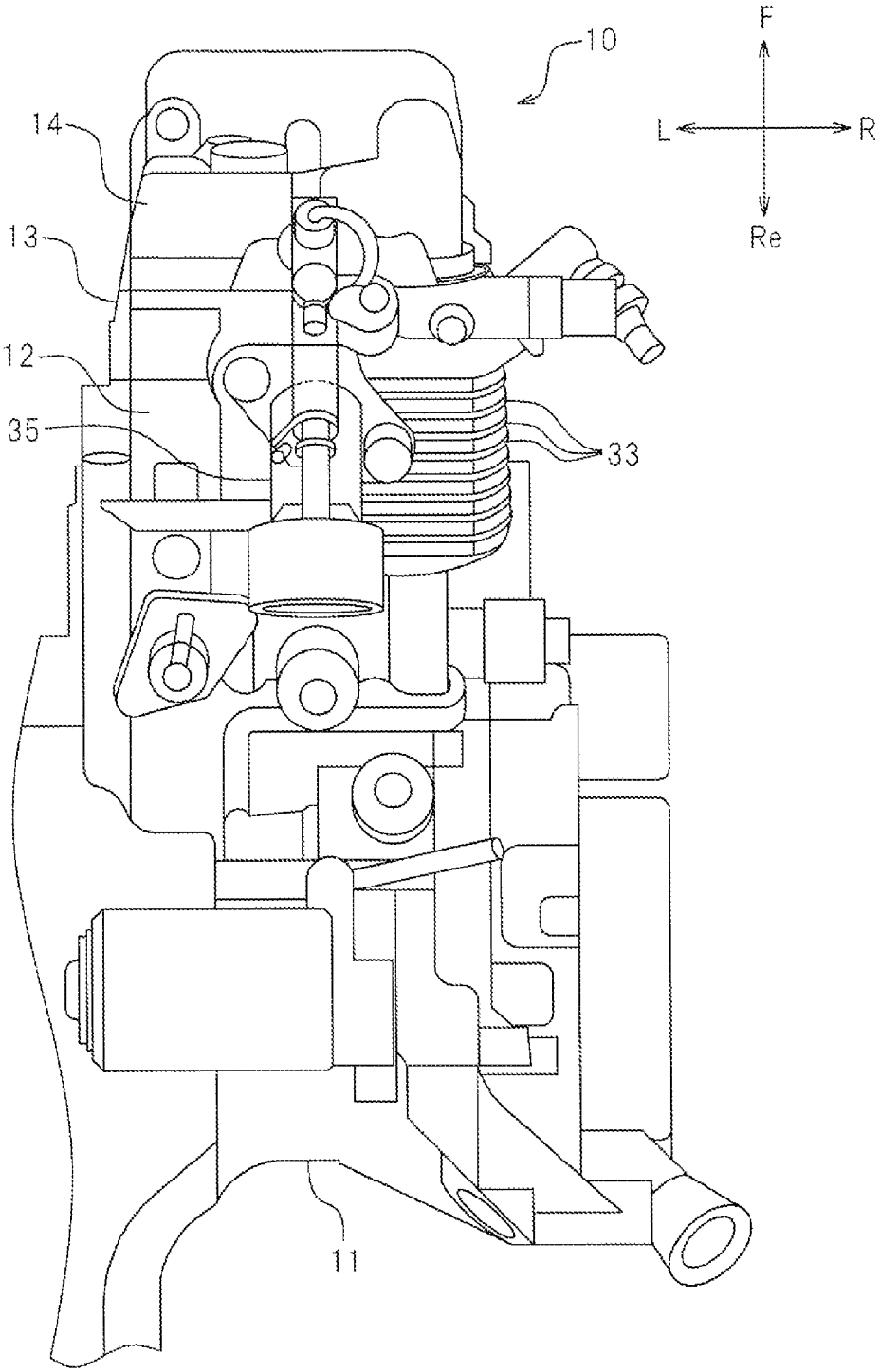
FIG. 9 is a plan view of a front portion of the engine not covered by the shroud.
Figure 10:
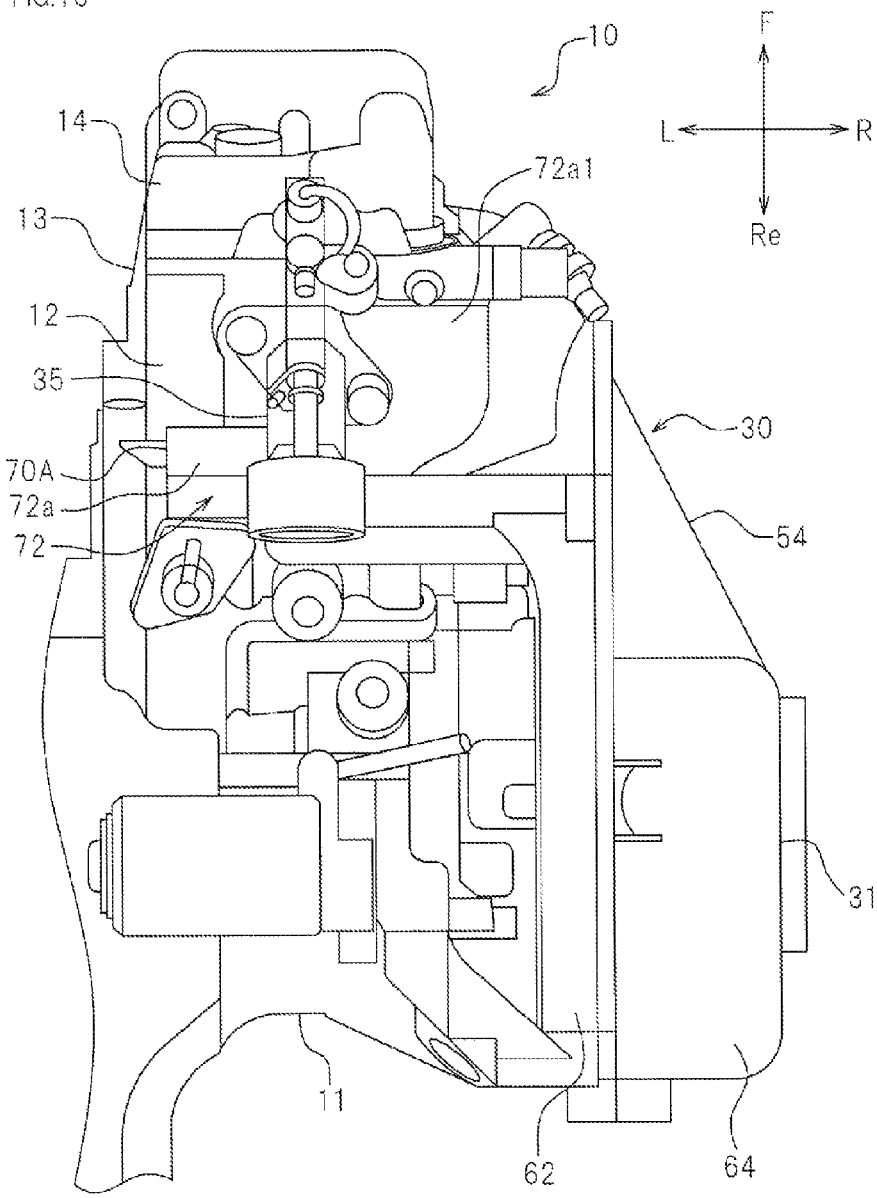
FIG. 10 is a plan view of the front portion of the engine covered by the shroud.

FIG. 9 is a plan view of a front portion of the engine 10 not covered by the shroud 30. FIG. 10 is a plan view of the front portion of the engine 10 covered by the shroud 30. As illustrated in FIG. 9, the engine 10 preferably includes the crankcase 11, the cylinder block 12, the cylinder head 13, and the cylinder head cover 14. As illustrated in FIG. 10, the shroud 30 is attached to the crankcase 11, the cylinder block 12, and the cylinder head 13. The shroud 30 extends forward along the cylinder block 12 and the cylinder head 13. A portion of the shroud 30 covers a right side region of the crankcase 11, a right side region of the cylinder block 12, and a right side region of the cylinder head 13. The other portion of the shroud 30 covers a portion of upper and lower regions of the cylinder block 12, and a portion of upper and lower regions of the cylinder head 13.

As illustrated in FIG. 3, the generator 27 is located inside the shroud 30. The shroud 30 according to the present preferred embodiment includes an inner wall portion 52 and an outer wall portion 54. The inner wall portion 52 is preferably defined by the rear wall 72*c* of the front portion 72 of the inner member 62, the inner wall 72*d* (see FIG. 5) of the front portion 72 of the inner member 62, and a portion of a front side region of the rear portion 71 of the inner member 62. The outer wall portion 54 is preferably defined by the other portions of the inner member 62 and the outer member 64. In the present preferred embodiment, the inner wall portion 52 covers a lateral surface of a portion of the crankcase 11, and a lateral surface of a portion of the cylinder block 12. The inner wall portion 52 is located laterally of a portion of the crankcase 11 and a portion of the cylinder block 12. More specifically, the inner wall portion 52 covers a lateral surface of a portion of the crankcase 11, and a lateral surface of a region 13*d* of the cylinder block 12 where no fin 33 is provided. The inner wall portion 52 does not cover lateral surfaces of the fins 33 of the cylinder block 12. However, the location of the inner wall portion 52 according to the present preferred embodiment is described by way of example only, and may be variously changed. For example, the inner wall portion 52 may cover lateral surfaces of a portion of the fins 33 of the cylinder block 12. The inner wall portion 52 may cover at least a portion of the crankcase 11, at least a portion of the cylinder block 12, or at least a portion of the cylinder head 13. The inner wall portion 52 may be located laterally of at least a portion of the crankcase 11, at least a portion of the cylinder block 12, or at least a portion of the cylinder head 13.

When a cross section passing through a center L2 of the crankshaft 17 and parallel to the cylinder axis L1 is viewed in a direction perpendicular to the cross section, one end 52*b* of the inner wall portion 52 is located laterally of the crankcase 11. In the present preferred embodiment, the cylinder axis L1 extends substantially horizontally. Therefore, FIG. 3 can be substantially regarded as a diagram obtained when the cross section passing through the center L2 of the crankshaft 17 and parallel to the cylinder axis L1 is viewed in the direction perpendicular to the cross section. The other end 52*c* of the inner wall portion 52 is located laterally of a region of the cylinder block 12 closer to the cylinder head 13 than the bottom dead center BDC of the piston 50 (i.e., a region of the cylinder block 12 above the bottom dead center BDC of the piston 50 in FIG. 3). The other end 52*c* of the inner wall portion 52 abuts against the region of the cylinder block 12 closer to the cylinder head 13 than the bottom dead center BDC of the piston 50. The inner wall portion 52 includes the rear wall 72*c* and a portion of a longitudinal wall portion 58 described later.

The outer wall portion 54 covers the cooling fan 28, the inner wall portion 52, a portion of the crankcase 11, a portion of the cylinder block 12, and a portion of the cylinder head 13. The outer wall portion 54 is located laterally of the cooling fan 28, the inner wall portion 52, a portion of the crankcase 11, a portion of the cylinder block 12, and a portion of the cylinder head 13. Note that the outer wall portion 54 may cover the cooling fan 28, the inner wall portion 52, a portion of the crankcase 11, at least a portion of the cylinder block 12, and at least a portion of the cylinder head 13.

As mentioned above, the suction port 31 is provided in the outer member 64 of the shroud 30. The suction port 31 is located rightward of the cooling fan 28. In other words, the suction port 31 is provided in a region of the outer wall portion 54 facing the cooling fan 28. The inner wall portion 52 is located closer to the cylinder head 13 than the suction port 31 (i.e., above the suction port 31 in FIG. 3). When the cross section passing through the center L2 of the crankshaft 17 and parallel to the cylinder axis L1 is viewed in the direction perpendicular to the cross section, the inner wall portion 52 protrudes toward the outer wall portion 54 (i.e., rightward in FIG. 3). Thus, at least a portion of the inner wall portion 52 is located closer to the outer wall portion 54 than a line connecting the ends 52*b* and 52*c* of the inner wall portion 52.

The inner and outer wall portions 52 and 54 define a duct 56 extending from the suction port 31 to reach a portion of the cylinder block 12 and a portion of the cylinder head 13. The reference signs "56*i*" and "56*o*" in FIG. 3 represent an inlet and an outlet of the duct 56, respectively (see also FIG. 5). In the present preferred embodiment, the duct 56 preferably has no hole between the inlet 56*i* and the outlet 56*o*. That is, the duct 56 is an enclosed duct. The duct 56 defines and serves as an air passage defined by the shroud 30. In the present preferred embodiment, the duct 56 preferably is defined only by the shroud 30. However, even when the duct 56 includes a hole between the inlet 56*i* and the outlet 56*o*, air can be guided from the inlet 56*i* to the outlet 56*o*. Therefore, the duct 56 may include a hole between the inlet 56*i* and the outlet 56*o*. For example, the duct 56 may include a sensor cooling hole or the like through which air is supplied to a component such as a knock sensor 81.

The inlet 56*i* of the duct 56 is preferably defined by an end 52*a* of the inner wall portion 52 located close to the cooling fan 28 and the outer wall portion 54. A region of the duct 56 located downstream of the inlet 56*i* includes a flow passage cross-sectional area smaller than that of the inlet 56*i*. In other words, between the inlet 56*i* and the outlet 56*o* of the duct 56, there is provided a region having a flow passage cross-sectional area smaller than that of the inlet 56*i*. The duct 56 is arranged so that air introduced through the inlet 56*i* is temporarily throttled, and thus the air is increased in velocity and then guided to the outlet 56*o*.

Note that as mentioned above, the recess 65 that prevents contact between the shroud 30 and the body frame 9 is provided in the outer member 64. Consequently, as illustrated in FIG. 3, a bottom side region of the recess 65 is bulged toward the inner wall portion 52. In a region of the duct 56 adjacent to the bottom side region of the recess 65, the duct 56 has a smaller flow passage cross-sectional area.

As mentioned above, the rear portion 71 of the inner member 62 preferably has a substantially tubular shape (see FIG. 5). The cooling fan 28 is attached to the right end portion of the crankshaft 17. The right end portion of the crankshaft 17 defines a rotation shaft of the cooling fan 28. As illustrated in FIG. 3, the inner member 62, for example, defines the longitudinal wall portion 58 surrounding a periphery of the cooling fan 28 when viewed in the direction of the rotation shaft of the cooling fan 28 (i.e., when viewed from the right or left). The longitudinal wall portion 58 may surround at least a portion of the periphery of the cooling fan 28 when viewed in the direction of the rotation shaft of the cooling fan 28. In the present preferred embodiment, the longitudinal wall portion 58 surrounds a periphery of the generator 27. However, a right side region of the longitudinal wall portion 58 may be extended rightward, and the longitudinal wall portion 58 may surround the periphery of at least a portion of the cooling fan 28. A portion of the inner wall portion 52 (i.e., a lower region of the inner wall portion 52 in FIG. 3) also serves as a portion of the longitudinal wall portion 58. The reference sign "F1" in FIG. 4 represents a virtual line schematically indicating an outer periphery of the cooling fan 28. The outer periphery of the cooling fan 28 refers to a circumferential track created by an outer peripheral end of the cooling fan 28. The longitudinal wall portion 58 is arranged so that a distance J between the longitudinal wall portion 58 and the outer periphery F1 of the cooling fan 28 is gradually increased from a reference point Q along a rotation direction B of the cooling fan 28. The reference point Q is located forward of a rotation center of the cooling fan 28 (in the present preferred embodiment, this rotation center corresponds to the center L2 of the crankshaft 17). The reference point Q is located lower than the rotation center of the cooling fan 28. The longitudinal wall portion 58 defines a "spiral casing".

Figure 11:
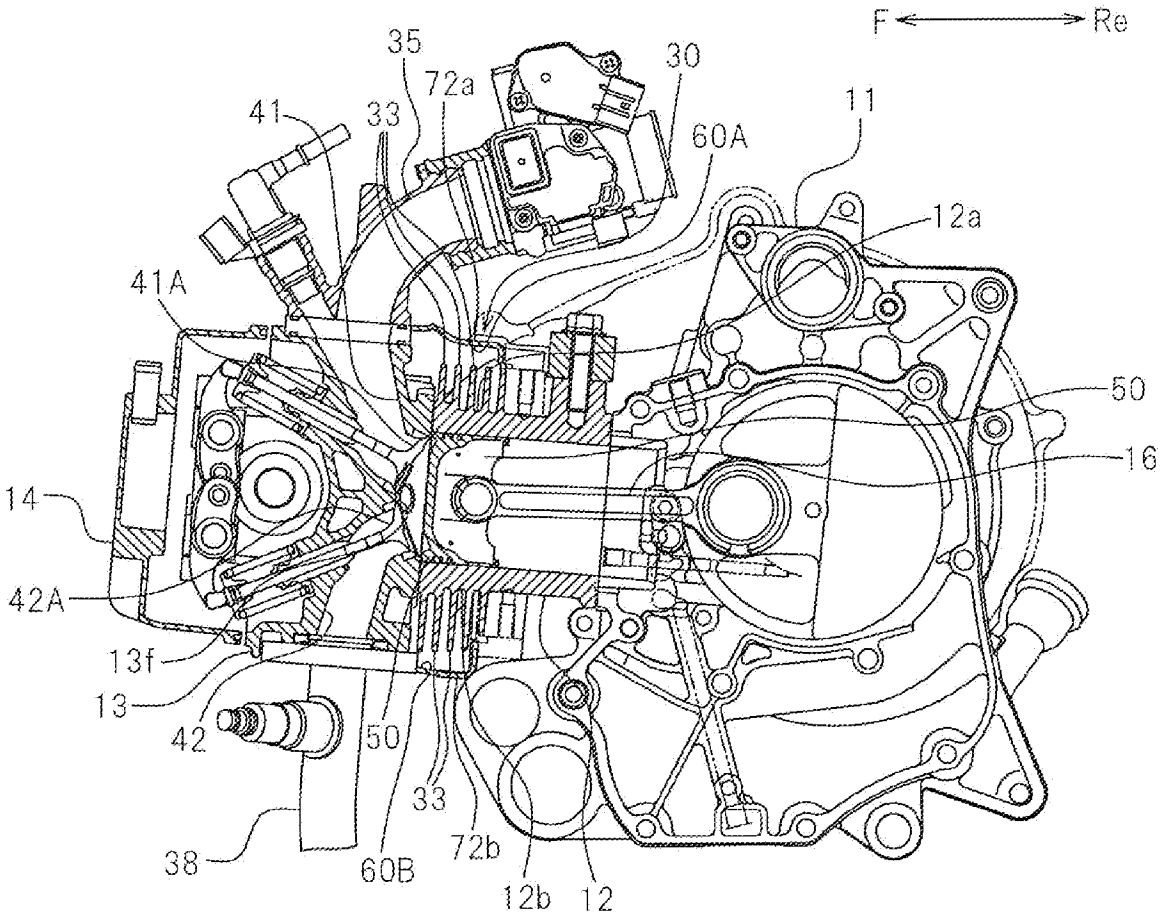
FIG. 11 is a left side cross-sectional view of the engine.
Figure 12:
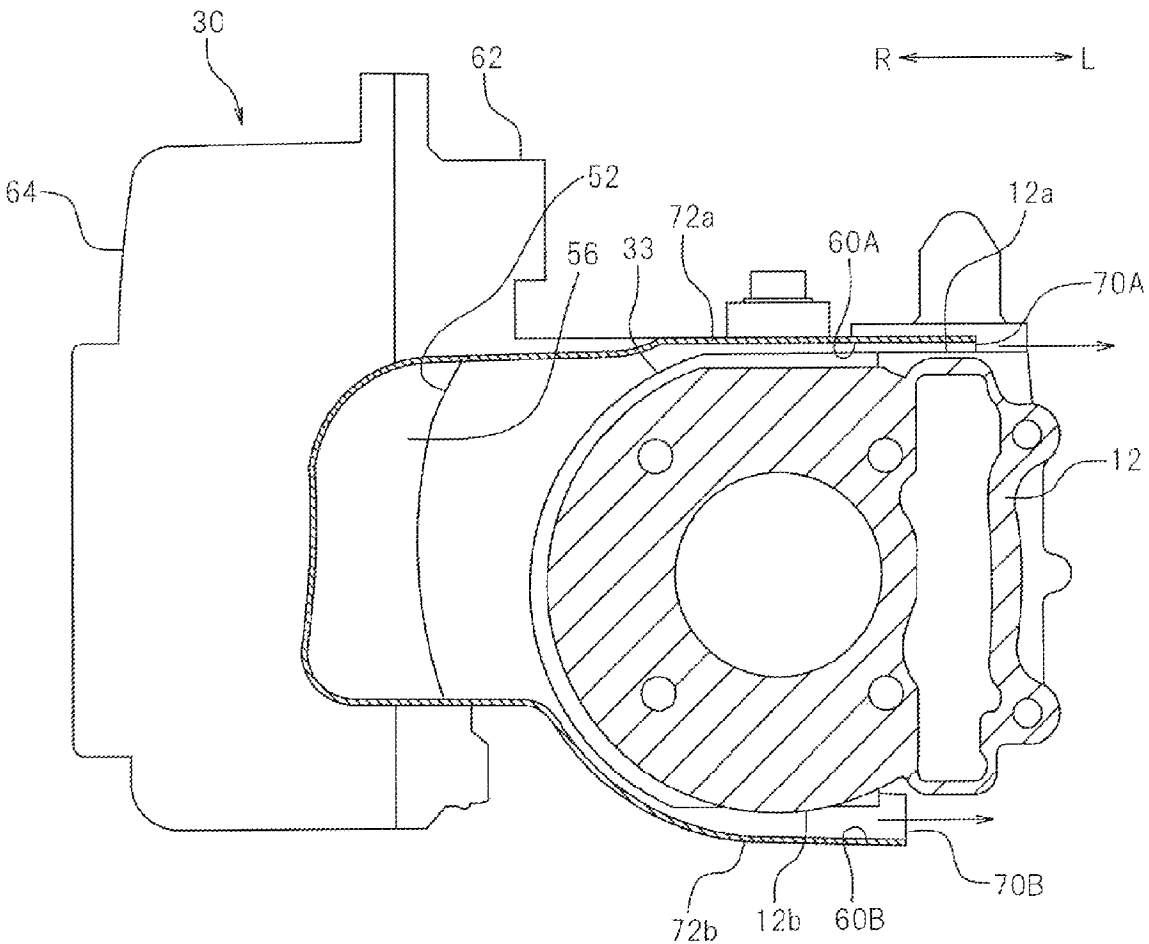
FIG. 12 is a cross-sectional view taken along the line XII-XII of FIG. 4.

FIG. 11 is a left side cross-sectional view of the engine 10. FIG. 12 is a cross-sectional view taken along the line XII-XII of FIG. 4. As illustrated in FIG. 11, the shroud 30 preferably includes an upper facing wall portion 60A facing portion of an upper surface 12*a* of the cylinder block 12, and a lower facing wall portion 60B facing portion of a lower surface 12*b* of the cylinder block 12. Note that the shroud 30 may include a facing wall portion facing at least portion of the upper surface or lower surface of the cylinder block 12.

The plurality of fins 33 are provided at surfaces of the cylinder block 12 facing the facing wall portions 60A and 60B. In other words, the plurality of fins 33 are preferably provided at a region of the upper surface 12*a* of the cylinder block 12 facing the facing wall portion 60A, and a region of the lower surface 12*b* of the cylinder block 12 facing the facing wall portion 60B. In the present preferred embodiment, the entire facing wall portions 60A and 60B face the fins 33, but a portion of or the entire facing wall portion 60A or 60B does not necessarily have to face the fins 33. At least a portion of the facing wall portion 60A and/or 60B may face a region of the cylinder block 12 where no fin 33 is provided.

As illustrated in FIG. 11, in the present preferred embodiment, a distance between the facing wall portion 60A of the shroud 30 and the fins 33 of the cylinder block 12 is greater than the interval between the fins 33. A distance between the facing wall portion 60B and the fins 33 is also greater than the interval between the fins 33. Note that the distance between the facing wall portion 60A or 60B and the fins 33 refers to a distance between the facing wall portion 60A or 60B and tips of the fins 33. The interval between the fins 33 refers to an interval between tip portions of the fins 33.

Figure 13:
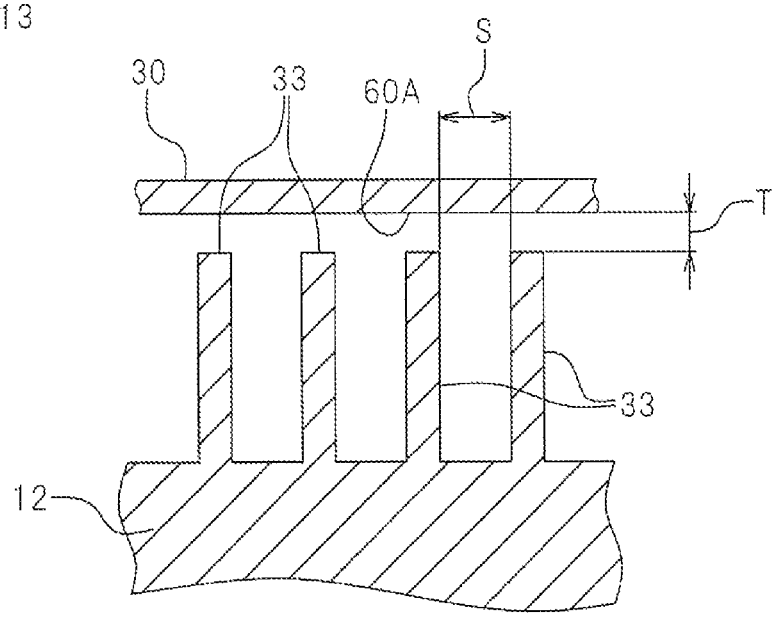
FIG. 13 is a cross-sectional view illustrating a facing wall portion of the shroud and a cylinder block according to a variation of the first preferred embodiment of the present invention.

It is to be noted that as illustrated in FIG. 13, a distance T between the facing wall portion 60A and the fins 33 may be smaller than an interval S between the fins 33. Alternatively, the distance T between the facing wall portion 60A and the fins 33 may be equal to the interval S between the fins 33. Although not illustrated, the distance between the facing wall portion 60B and the fins 33 may be similarly smaller than the interval between the fins 33, or equal to the interval between the fins 33. The distance between the facing wall portion 60A and the fins 33 may be equal to the distance between the facing wall portion 60B and the fins 33. The distance between the facing wall portion 60A and the fins 33 may be smaller or greater than the distance between the facing wall portion 60B and the fins 33. Note that the foregoing relationship T<S may be established for all the fins 33 facing the facing wall portion 60A, or may be established for only some of the fins 33 facing the facing wall portion 60A. The same goes for the fins 33 facing the facing wall portion 60B. Similarly, the other foregoing relationships may be established for all the fins 33 facing the facing wall portion 60A or 60B, or may be established for only some of the fins 33 facing the facing wall portion 60A or 60B.

As illustrated in FIG. 12, a left end of the upper facing wall portion 60A of the shroud 30 is located rightward of that of the cylinder block 12. Between a left end region of the facing wall portion 60A and the upper surface 12*a* of the cylinder block 12, there is provided an exhaust opening 70A opened leftward. A left end of the lower facing wall portion 60B of the shroud 30 is also located rightward of that of the cylinder block 12. Between a left end region of the facing wall portion 60B and the lower surface 12*b* of the cylinder block 12, there is provided an exhaust opening 70B opened leftward. A portion of air inside the shroud 30 is discharged leftward through the exhaust openings 70A and 70B.

As indicated by the arrow A in FIG. 3, air outside the shroud 30 is introduced to the inside of the shroud 30 through the suction port 31 upon rotation of the cooling fan 28 in association with rotation of the crankshaft 17. The air introduced to the inside of the shroud 30 flows into the duct 56 through the inlet 56*i*. The duct 56 is preferably defined not only by the outer wall portion 54 but also by the inner wall portion 52, thus preventing a sharp increase in flow passage cross-sectional area and a reduction in flow velocity of the air. The air is smoothly introduced into the duct 56. At some position along the duct 56, the duct 56 preferably includes a flow passage cross-sectional area smaller than that of the inlet 56*i*. Thus, the air is temporarily increased in velocity inside the duct 56 and blown against the cylinder block 12 and the cylinder head 13 through the outlet 56*o*. As a result, the cylinder block 12 and the cylinder head 13 are cooled by the air. The air, which has cooled the cylinder block 12 and the cylinder head 13, is discharged to the outside of the shroud 30 through the exhaust openings 70A and 70B.

As described above, in the engine 10 according to the present preferred embodiment, the shroud 30 preferably includes not only the outer wall portion 54 but also the inner wall portion 52 as illustrated in FIG. 3. The inner and outer wall portions 52 and 54 define the duct 56 extending from the suction port 31 to reach at least a portion of the cylinder block 12 and/or at least a portion of the cylinder head 13, and thus the cross-sectional area of the air flow passage inside the shroud 30 is prevented from being sharply increased. Therefore, a reduction in flow velocity of air supplied by the cooling fan 28 can prevented. In the present preferred embodiment, the outlet 56*o* of the duct 56 is arranged so that air is supplied to a portion of the cylinder block 12 and to the cylinder head 13. Hence, the duct 56 can guide air at a high flow velocity to a region that should be cooled in a concentrated manner, and highly efficient local cooling is provided to this region. Consequently, according to the present preferred embodiment, cooling efficiency can be enhanced on the whole, thus enabling an improvement in fuel efficiency. Furthermore, fan power can be reduced or a resulting structure can be reduced in size.

According to the present preferred embodiment, the one end 52*b* of the inner wall portion 52 is located laterally of the crankcase 11, and the other end 52*c* of the inner wall portion 52 is located laterally of the region of the cylinder block 12 closer to the cylinder head 13 than the bottom dead center BDC of the piston 50. The other end 52*c* of the inner wall portion 52 abuts against the region of the cylinder block 12 closer to the cylinder head 13 than the bottom dead center BDC of the piston 50. Thus, air can be guided at a high flow velocity to the region of the cylinder block 12 closer to the cylinder head 13 than the bottom dead center BDC of the piston 50, and the cylinder head 13. Temperatures of the above-described region and the cylinder head 13 are more likely to increase than those of the other regions. Accordingly, air is guided at a high flow velocity to the above-described region and the cylinder head 13 so as to make it possible to enhance cooling efficiency on the whole.

According to the present preferred embodiment, the inlet 56*i* of the duct 56 is preferably defined by the end 52*a* of the inner wall portion 52 located close to the cooling fan 28, and the outer wall portion 54. Thus, the flow velocity of air can be increased at some position along the duct 56. Accordingly, a reduction in flow velocity of air can be effectively prevented, thus making it possible to perform highly efficient local cooling outside of the outlet 56*o* of the duct 56.

According to the present preferred embodiment, the shroud 30 preferably includes the longitudinal wall portion 58. Since the longitudinal wall portion 58 is provided, the inner wall portion 52 can be easily located closer to the outer wall portion 54, and the flow passage cross-sectional area inside the shroud 30 can be reduced. Thus, it is possible to achieve a further increase in air flow velocity resulting from a reduction in flow passage cross-sectional area. According to the present preferred embodiment, a portion of the inner wall portion 52 also serves as a portion of the longitudinal wall portion 58. A portion of the inner wall portion 52 and a portion of the longitudinal wall portion 58 each serve a dual role in this manner so as to make it possible to reduce the number of components and to cut down the cost of manufacturing the shroud 30. Furthermore, the shroud 30 can be reduced in size.

According to the present preferred embodiment, as illustrated in FIG. 4, the longitudinal wall portion 58 of the shroud 30 is arranged so that the distance J between the longitudinal wall portion 58 and the outer periphery F1 of the cooling fan 28 is gradually increased along the rotation direction B of the cooling fan 28. Thus, the spiral casing can be arranged around the cooling fan 28 so as to allow air to be efficiently supplied from the cooling fan 28 to the duct 56.

In the present preferred embodiment, as illustrated in FIG. 11, the shroud 30 preferably includes the facing wall portions 60A and 60B. At least the surfaces of the cylinder block 12 facing the facing wall portions 60A and 60B are provided with the plurality of fins 33. Air introduced into the duct 56 is supplied mainly to a right side region of the cylinder block 12 and is then divided into upper airflow flowing above the cylinder block 12 and lower airflow flowing below the cylinder block 12. The upper airflow flows between the facing wall portion 60A and the upper surface 12*a*, and the lower airflow flows between the facing wall portion 60B and the lower surface 12*b*. Since a distance between the facing wall portion 60A and the upper surface 12*a* and a distance between the facing wall portion 60B and the lower surface 12*b* are short, air flows along the upper and lower surfaces 12*a* and 12*b* at a high flow velocity. Therefore, the upper and lower surfaces 12*a* and 12*b* of the cylinder block 12 can be cooled at high cooling efficiency.

As illustrated in FIG. 13, when the distance T between the facing wall portion 60A and the fins 33 is set to be smaller than the interval S between the fins 33, the amount of air flowing through gaps between the fins 33 will be greater than the amount of air flowing between the facing wall portion 60A and the fins 33. Similarly, when the distance between the facing wall portion 60B and the fins 33 is set to be smaller than the interval between the fins 33, the amount of air flowing through gaps between the fins 33 will be greater than the amount of air flowing between the facing wall portion 60B and the fins 33. Therefore, the upper and lower surfaces 12*a* and 12*b* of the cylinder block 12 can be cooled at higher cooling efficiency. Note that the shroud 30 is arranged so that air supplied through the duct 56 is guided leftward in the present preferred embodiment, but the shroud 30 and the cooling fan 28, for example, may be located and defined as mirror images of the shroud 30 and the cooling fan 28 illustrated in the present preferred embodiment. In other words, the shroud 30 may be arranged so that air supplied through the duct 56 is guided rightward.

In the present preferred embodiment, the shroud 30 is preferably defined by the inner and outer members 62 and 64. The outer member 64 defines at least a portion of the outer wall portion 54, and the inner member 62 defines at least the inner wall portion 52. The inner wall portion 52 and at least a portion of the outer wall portion 54 are defined by separate members, and these members are assembled to each other afterward, thus making it possible to easily provide the shroud 30 including the inner and outer wall portions 52 and 54.

In the present preferred embodiment, the inner and outer members 62 and 64 constituting the shroud 30 preferably are each made of a resin material, for example. Therefore, the shroud 30 can be easily formed. Furthermore, the shroud 30 can be reduced in weight.

As illustrated in FIG. 3, the reinforcement ribs 66 are preferably provided in a region of the inner wall portion 52 of the inner member 62 located toward the center of the cylinder 15 (i.e., leftward of the inner wall portion 52 in FIG. 3). Since the reinforcement ribs 66 are preferably provided, rigidity of the inner wall portion 52 can be maintained at a high level. Accordingly, flexibility in shape and location of the inner wall portion 52 can be increased.

In the present preferred embodiment, as illustrated in FIG. 8, the recess 65 is provided in a region of the outer wall portion 54 facing the body frame 9. Thus, it is possible to allow the shroud 30 to be located close to the body frame 9 while avoiding interference between the shroud 30 and the body frame 9. Hence, the interval between the shroud 30 and the body frame 9 can be reduced to enable the motorcycle 1 to be reduced in size. Accordingly, installation of the engine 10 on the motorcycle 1 can be further facilitated.

Second Preferred Embodiment

Figure 14:
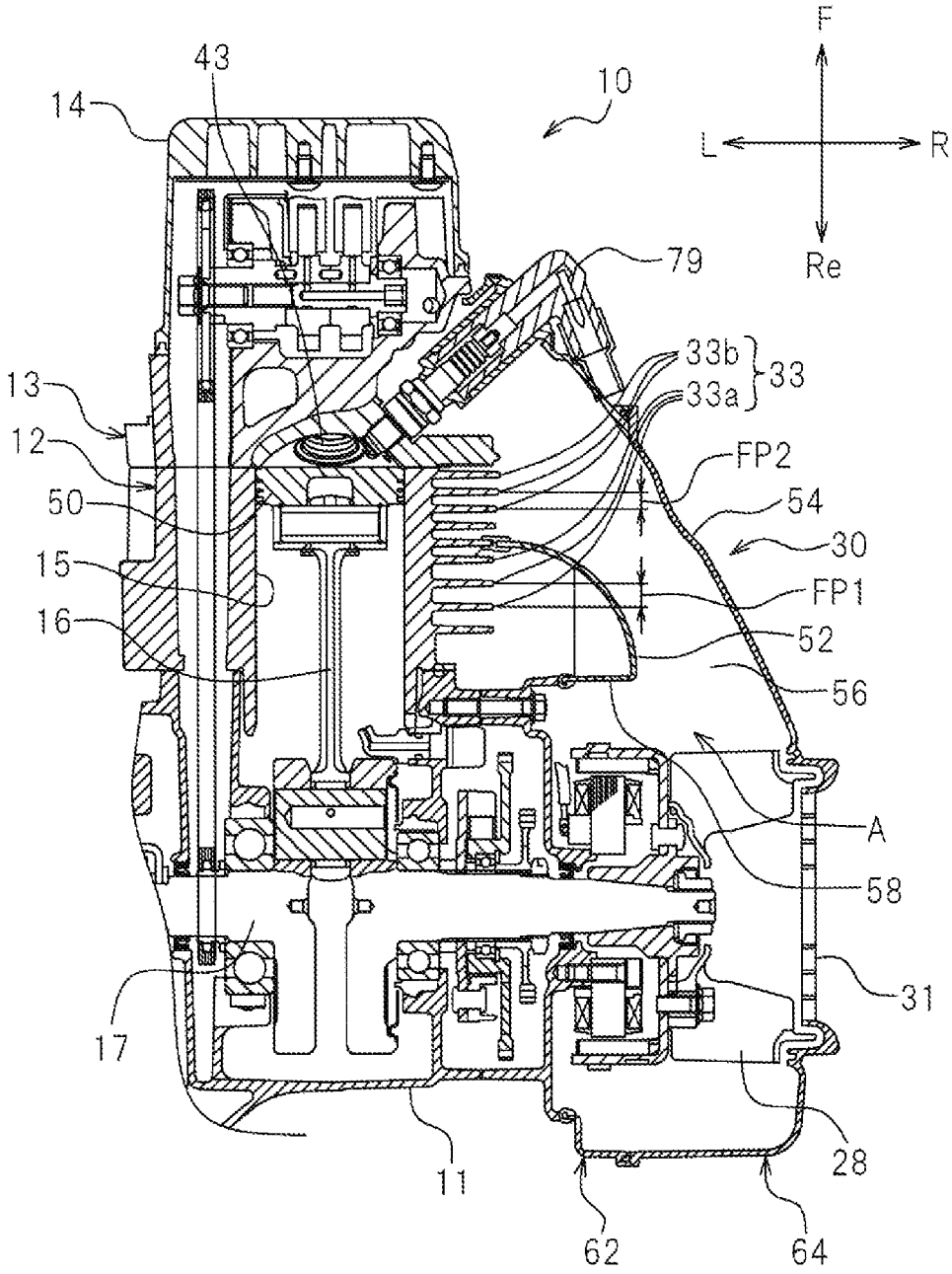
FIG. 14 is an enlarged view of portion of an engine according to a second preferred embodiment of the present invention.

As illustrated in FIG. 3, in the engine 10 according to the first preferred embodiment, preferably, no fin 33 is provided in a region of the cylinder block 12 overlapping the inner wall portion 52 in side view (i.e., a region of the cylinder block 12 located leftward of the inner wall portion 52 in FIG. 3). As illustrated in FIG. 14, in the engine 10 according to the second preferred embodiment, the fins 33 preferably are also provided in the region of the cylinder block 12 overlapping the inner wall portion 52 in side view.

In the present preferred embodiment, the cylinder block 12 is provided with the fins 33 including first fins 33*a* and second fins 33*b*. At least some of the first fins 33*a* are located at positions overlapping the inner wall portion 52 in side view. At least some of the second fins 33*b* are located at positions that overlap the outer wall portion 54 in side view but do not overlap the inner wall portion 52 in side view. A fin pitch FP1 between the first fins 33*a* and a fin pitch FP2 between the second fins 33*b* are different. In this preferred embodiment, the fin pitch FP1 between the first fins 33*a* is greater than the fin pitch FP2 between the second fins 33*b*.

Other features of the second preferred embodiment are similar to those of the first preferred embodiment. Therefore, other elements are identified by the same reference signs as those used in the first preferred embodiment, and description thereof will be omitted.

Some of the first fins 33*a* are located laterally of the inner wall portion 52 of the shroud 30, but upper and lower regions of the inner wall portion 52 are opened (see FIG. 5). Although air is not supplied from the cooling fan 28 to the first fins 33*a*, air outside the shroud 30 is allowed to flow along the first fins 33*a*. The first fins 33*a* are cooled by natural convection or cooled by an air current resulting from running of the motorcycle 1. The second fins 33*b* are cooled by an air current produced by the cooling fan 28. The second fins 33*b* are cooled by forced convection.

In the present preferred embodiment, the fin pitch FP1 between the first fins 33*a* and the fin pitch FP2 between the second fins 33*b* are different from each other, thus making it possible to vary cooling characteristics between a region of the cylinder block 12 to which air from the cooling fan 28 is not guided (i.e., a region of the cylinder block 12 located laterally of the inner wall portion 52) and a region of the cylinder block 12 to which air from the cooling fan 28 is guided (i.e., a region of the cylinder block 12 not located laterally of the inner wall portion 52). The cooling characteristic is appropriately set for each spot of the cylinder block 12, and whether to supply air thereto is appropriately set, thus enabling cooling in various modes.

In the present preferred embodiment, the fin pitch FP1 between the first fins 33*a* is preferably greater than the fin pitch FP2 between the second fins 33*b*. When the fin pitch is small, air resistance is increased. Therefore, air might not smoothly flow in that case. However, the flow velocity of air guided to the second fins 33*b* is higher than that of air guided to the first fins 33*a*. Hence, air is allowed to suitably flow around the second fins 33*b* so as to enable effective cooling.

Other Preferred Embodiments

The engine 10 according to each preferred embodiment described above preferably is a transverse engine in which the cylinder axis L1 extends horizontally or substantially horizontally. However, the direction of the cylinder axis L1 is not limited to a horizontal direction or a substantially horizontal direction. The engine 10 may be a "longitudinal" engine in which the cylinder axis L1 extends substantially vertically. For example, the cylinder axis L1 may have an inclination angle of about 45° or more or an inclination angle of about 60° or more with respect to a horizontal plane in that case.

The engine 10 is not limited to a unit swing type engine that swings with respect to the body frame 9, but may be an engine fixed to the body frame 9 so as not to be swingable.

In each of the foregoing preferred embodiments, the cooling fan 28 preferably is driven by the crankshaft 17. However, the fan that produces an air current is not limited to one driven by the crankshaft 17. For example, a fan driven by an electric motor may be used. Such a fan is equivalent to a cooling fan rotated together with the crankshaft 17, as long as it is driven at least during operation of the engine 10.

Although the preferred embodiments of the present invention have been described in detail thus far, each of the foregoing preferred embodiments has been described by way of example only. The present invention disclosed herein includes diverse variations or modifications of each of the foregoing preferred embodiments.

While preferred embodiments of the present invention have been described above, it is to be understood that variations and modifications will be apparent to those skilled in the art without departing from the scope and spirit of the present invention. The scope of the present invention, therefore, is to be determined solely by the following claims.

What is claimed is:

1. An internal combustion engine comprising:

a crankshaft;

a crankcase supporting the crankshaft;

a cylinder block connected to the crankcase and including a cylinder provided therein;

a piston connected to the crankshaft via a connecting rod and located inside the cylinder so as to be movable in a reciprocating manner;

a cylinder head superposed on the cylinder block so as to cover the cylinder, defining a combustion chamber together with the cylinder and the piston, and including an intake port and an exhaust port in communication with the combustion chamber;

a cooling fan rotated together with the crankshaft;

a shroud including an inner wall portion located laterally of at least one of a portion of the crankcase, a portion of the cylinder block and a portion of the cylinder head, and an outer wall portion arranged to cover the cooling fan, the inner wall portion, a portion of the crankcase, at least a portion of the cylinder block, and at least a portion of the cylinder head; and a suction port arranged to suction air and located in a region of the outer wall portion facing the cooling fan; wherein the inner and outer wall portions define a duct extending from the suction port to reach at least a portion of the cylinder block and/or at least a portion of the cylinder head; and when a cross section passing through a center of the crankshaft and extending parallel to an axis of the cylinder is viewed in a direction perpendicular to the cross section, a first end of the inner wall portion is located laterally of the crankcase, and a second end of the inner wall portion is located laterally of a region of the cylinder block closer to the cylinder head than a bottom dead center of the piston.

2. The internal combustion engine according to claim 1, wherein the second end of the inner wall portion abuts against the region of the cylinder block closer to the cylinder head than the bottom dead center of the piston.

3. The internal combustion engine according to claim 1, wherein an inlet of the duct is defined by an end of the inner wall portion located close to the cooling fan and the outer wall portion; and at some position along the duct, there is provided a region having a flow passage cross-sectional area smaller than that of the inlet of the duct.

4. The internal combustion engine according to claim 1, wherein the cooling fan includes a rotation shaft;

the shroud includes a longitudinal wall portion that extends in a direction parallel or substantially parallel to a direction of the rotation shaft of the cooling fan or in a direction inclined with respect to the direction of the rotation shaft, and that surrounds at least a portion of a periphery of the cooling fan when viewed in the direction of the rotation shaft of the cooling fan; and a portion of the inner wall portion also defines a portion of the longitudinal wall portion.

5. The internal combustion engine according to claim 1, wherein the cooling fan includes a rotation shaft;

the shroud includes a longitudinal wall portion that extends in a direction parallel or substantially parallel to a direction of the rotation shaft of the cooling fan or in a direction inclined with respect to the direction of the rotation shaft, and that surrounds at least a portion of a periphery of the cooling fan when viewed in the direction of the rotation shaft of the cooling fan; and the longitudinal wall portion is arranged so that a distance between the longitudinal wall portion and an outer periphery of the cooling fan is gradually increased along a rotation direction of the cooling fan.

6. The internal combustion engine according to claim 1, wherein the crankshaft extends rightward and leftward;

the cylinder extends in a horizontal direction or extends obliquely upward with respect to the horizontal direction;

the shroud includes a facing wall portion extending rightward or leftward from the duct and facing an upper or lower surface of at least a portion of the cylinder block;

at least in a region of the cylinder block facing the facing wall portion, there are provided a plurality of fins; and a distance between at least some of the plurality of fins and the facing wall portion is smaller than an interval between the plurality of fins.

7. The internal combustion engine according to claim 1, wherein the shroud includes an inner member located toward an axis of the cylinder when a cross section passing through a center of the crankshaft and parallel to the cylinder axis is viewed in a direction perpendicular to the cross section and an outer member that is separate from the inner member and located opposite to the inner member located toward the axis of the cylinder;

the outer member defines at least a portion of the outer wall portion;

the inner member defines at least the inner wall portion; and the inner and outer members are connected to each other.

8. The internal combustion engine according to claim 7, wherein the inner and outer members are each made of a resin material.

9. The internal combustion engine according to claim 7, wherein in a region of the inner wall portion of the inner member located toward the axis of the cylinder, a reinforcement rib is provided.

10. The internal combustion engine according to claim 1, wherein the internal combustion engine is a single-cylinder engine.

11. The internal combustion engine according to claim 1, wherein the inner wall portion is located laterally of a portion of the cylinder block;

a plurality of first fins are provided in a region of the cylinder block located laterally of the inner wall portion;

a plurality of second fins are provided in a region of the cylinder block which is not located laterally of the inner wall portion and which is covered by the outer wall portion; and a fin pitch between the first fins and a fin pitch between the second fins are different from each other.

12. The internal combustion engine according to claim 11, wherein the fin pitch between the first fins is greater than the fin pitch between the second fins.

13. A straddle-type vehicle comprising:

the internal combustion engine according to claim 1.

14. The straddle-type vehicle according to claim, wherein the vehicle includes a body frame facing the outer wall portion; and a recess is provided in a region of the outer wall portion facing the body frame.

15. An internal combustion engine comprising:

a crankshaft;

a crankcase supporting the crankshaft;

a cylinder block connected to the crankcase and including a cylinder provided therein;

a piston connected to the crankshaft via a connecting rod and located inside the cylinder so as to be movable in a reciprocating manner;

a cylinder head superposed on the cylinder block so as to cover the cylinder, defining a combustion chamber together with the cylinder and the piston, and including an intake port and an exhaust port in communication with the combustion chamber;

a driving pulley attached to a first end portion of the crankshaft;

a cooling fan attached to a second end portion of the crankshaft;

a shroud including an inner wall portion located laterally of at least one of a portion of the crankcase, a portion of the cylinder block and a portion of the cylinder head, and an outer wall portion arranged to cover the cooling fan, the inner wall portion, a portion of the crankcase, at least a portion of the cylinder block, and at least a portion of the cylinder head; and a suction port arranged to suction air and located in a region of the outer wall portion facing the cooling fan; wherein the inner and outer wall portions define a duct extending from the suction port to reach at least a portion of the cylinder block and/or at least a portion of the cylinder head.

* * * * *